United States Patent [19]

Thorsnes

[11] Patent Number: 4,662,780

[45] Date of Patent: May 5, 1987

[54] METHOD FOR DOCKING OF A FLOATING STRUCTURE

[75] Inventor: Ola Ø. Thorsnes, Oslo, Norway

[73] Assignee: Selvaag-Bygg A/S, Oslo, Norway

[21] Appl. No.: 790,118

[22] Filed: Oct. 22, 1985

[51] Int. Cl.[4] ..... E02R 17/00

[52] U.S. Cl. ..... 405/1; 405/195; 405/203

[58] Field of Search ..... 405/1, 195, 203, 204, 405/205, 226

[56] References Cited

U.S. PATENT DOCUMENTS

| | | | |
|---|---|---|---|
| 826,096 | 7/1906 | Ferris | 405/195 |
| 3,466,878 | 9/1969 | Esquillan et al. | 405/203 |
| 3,526,096 | 9/1970 | Frein et al. | 405/195 |
| 3,911,687 | 10/1975 | Mo | 405/225 |
| 4,193,714 | 3/1980 | Gjerde | 405/195 |
| 4,422,803 | 12/1983 | Wetmore | 405/204 |
| 4,482,274 | 11/1984 | Bromdi et al. | 405/195 |
| 4,534,678 | 8/1985 | Nakazato et al. | 405/204 |
| 4,555,201 | 11/1985 | Paoluccio | 405/204 |

FOREIGN PATENT DOCUMENTS

| | | | |
|---|---|---|---|
| 0616782 | of 1961 | Canada | 405/195 |
| 0120912 | 7/1983 | Japan | 405/195 |

*Primary Examiner*—Cornelius J. Husar
*Assistant Examiner*—Kristina I. Hall
*Attorney, Agent, or Firm*—Larson and Taylor

[57] ABSTRACT

A method for docking of a floating structure, e.g. a concrete offshore platform. According to a first embodiment, a pit (3) separated from the sea by means of sand or gravel deposits (1; 4) is excavated, whereupon the structure (7) is erected entirely or partly in the pit (3). The depth of the pit (3) is increased by building the upper edge of the pit upwards to an upper level, whereupon the pit is filled with water (10) in order for the structure to become floating. The deposits (12) situated at the bottom of the pit (3) and under the structure (7) are next removed by means of suitable techniques in order to lower the bottom of the pit (3) to a lowest level, while the level (11) of the water (10) in the pit (3) is maintained. Then the level of the water (10) is lowered to a lower level (14) corresponding to the level of the sea (2) on the outside and the dike (4; 8) separating the pit from the sea is removed, whereupon the structure may be floated away from the pit. According to a modification, two pits are excavated next to each other, one being deeper than the other. After the structure is erected, the pits are filled with water and the structure is floated from the shallower to the deeper pit. Next, the water level of the pits is lowered to the level of the sea on the outside, whereupon the dike separating the pit from the sea is removed.

2 Claims, 6 Drawing Figures

METHOD FOR DOCKING OF A FLOATING STRUCTURE

The present invention relates to a method for docking of a floating structure, e.g. a concrete offshore platform, as indicated in the preamble of the appended independent claims.

When building floating structures, particularly concrete offshore platforms, a substantial part of the structure must be built while it is floating at sea. As described i.a. in U.S. Pat. No. 3,911,687, the lower part of the concrete platform is first built in a dry dock, the dock being built by making a dike, e.g. in a fjord arm or in an area of loose gravel or sand deposits adjacent the sea, whereupon the water inside the dike is pumped dry. The lower part of the concrete platform is then erected until its size provides sufficient buoyancy to permit removing the dock port and floating the platform to a deeper place, whereupon the further erection of the concrete platform takes place while it is gradually lowered into the water as the work proceedes. Experience has indicated that this known method may involve certain problems, i.a. in keeping the dock port watertight. In addition, the work involved in constructing the dock port is both time consuming and expensive. Furthermore, the structure must be floated out at a fairly early stage of the erection process. Also it is expensive to perform concrete casting at sea because of the need for personnel and material transport using boats, rigging on barges etc.

The present invention aims at reducing or avoiding some of the problems related to the known method, the platform being built at a site where the land area adjacent the sea generally consists of gravel or sand deposits.

According to the invention two solutions are suggested, depending on the distance from the sea at which the structure is built and the local ground conditions.

The characterizing features of the method are indicated in the appended claims.

The invention will be described more closely with reference to the exemplifying embodiments illustrated in the appended drawings, where:

FIGS. 1–3 illustrate a first solution according to the invention, while

Even though the following description relates to the building of a concrete platform, it will be understood that the present invention may also be used for any type of floating structure to be built on land and floated out, particularly very heavy structures.

Figure 1:
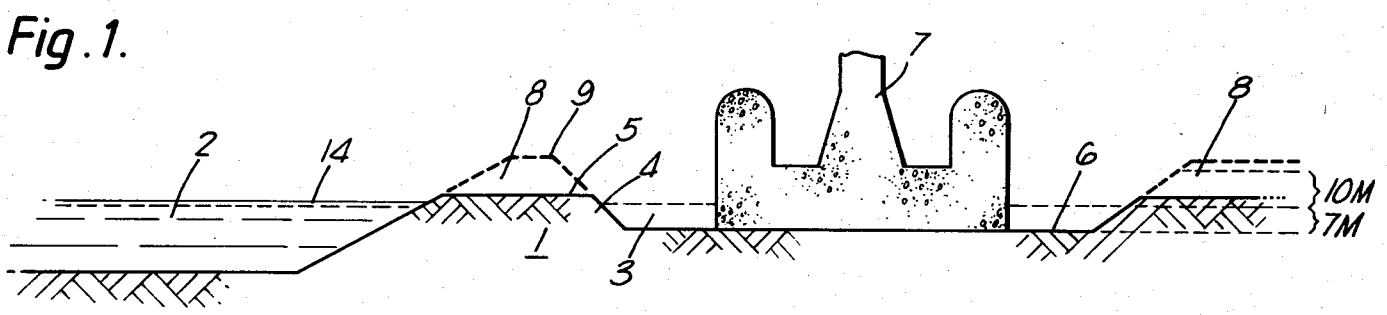

FIG. 1 shows a land area 1 adjacent the sea 2. In this land area a pit 3 is excavated, whereby a dike 4 is formed protecting the pit from the sea 2. The pit 3 is excavated from a first level 5 down to a second level 6, the first level 5 lying, or being brought to lie, some distance above the maximum level of the sea 2. In order to prevent slipping of the masses, the pit 3 must be sloped along the edges and the bottom width of the pit must be sufficiently large to provide free access for constructions machinery etc. to the concrete structure to be built. The floating structure 7, e.g. in the form of said concrete platform, is erected from the bottom 6 of the pit 3 and it may be erected to a level lying above the cell structure of the concrete platform. Depending on the buoyancy of the structure, it may be entirely or partly erected in the pit. In the chosen example the distance between the first and second levels may be 7 meters. Thereafter the depth of the pit is increased by building a dike 8 from said first level 5 to a third level 9. The distance between said first level and said third level may for example be 10 meters. In the chosen example the pit has thus been given a total depth of 17 meters.

Next, the pit 3 is filled with water to a level 11 until the structure floats in the pit 3. The level 11 may correspond approximately to the level 9. The dike 4; 8 now separates the water filled pit from the sea 2 on the outside. While the water in the pit 3 is held at said level 11, the deposits 12 situated in the existing pit 3 and thus under the floating structure, are pumped out or in other ways removed by means of conventional techniques, so that the depth of the pit 3 is increased down to a fourth level 13, which in the chosen example lies about 10 meters below said second level 6. Next, the water level in the pit 3 is lowered to a fifth level 14, corresponding to the level of the sea 2 on the outside. Thereafter the dike 4; 8 is removed, whereupon the floating structure 7 may be floated from the building site.

Figure 2:
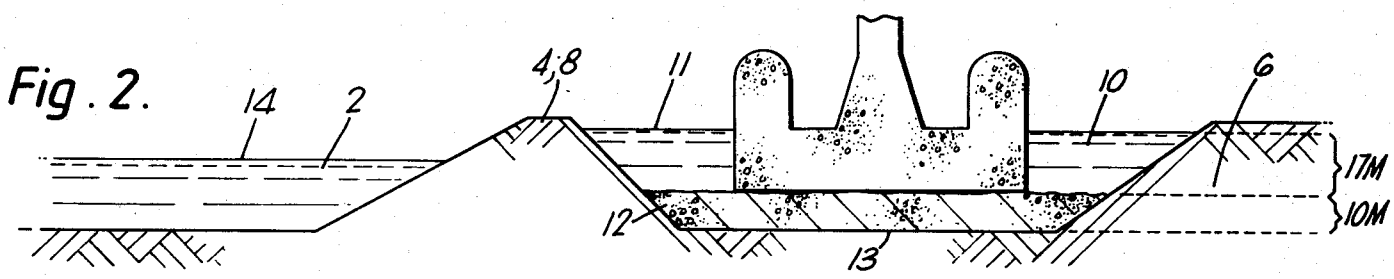
Figure 3:
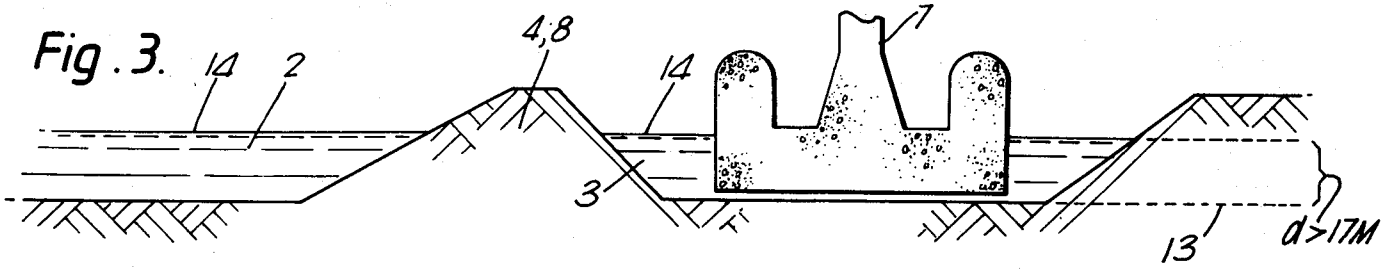
Figure 4:
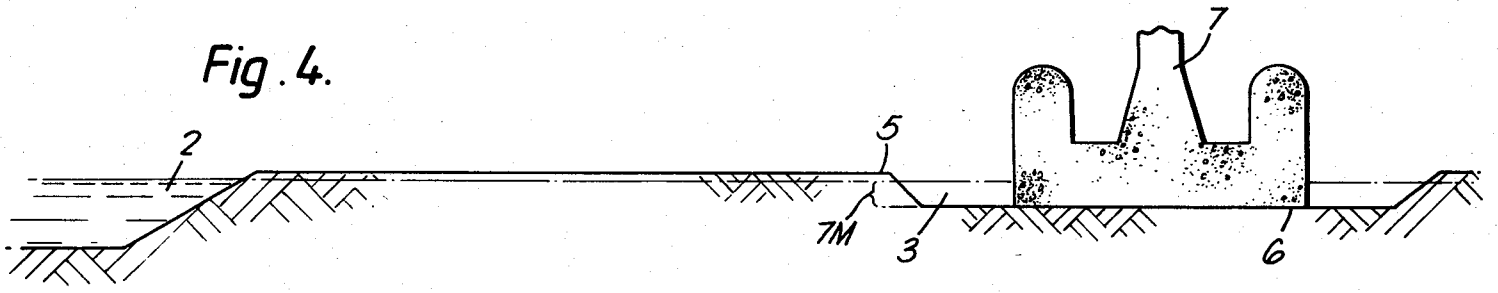
FIGS. 4–6 illustrate a second solution according to the invention.
Figure 5:
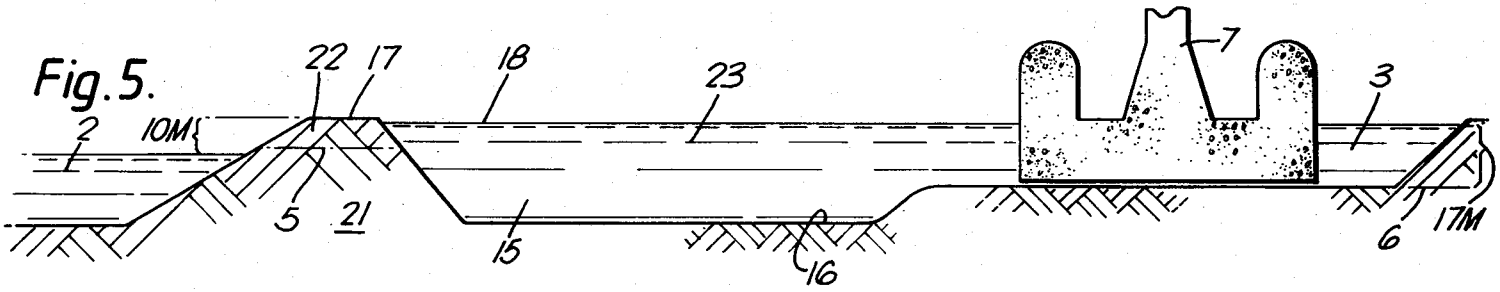
Figure 6:
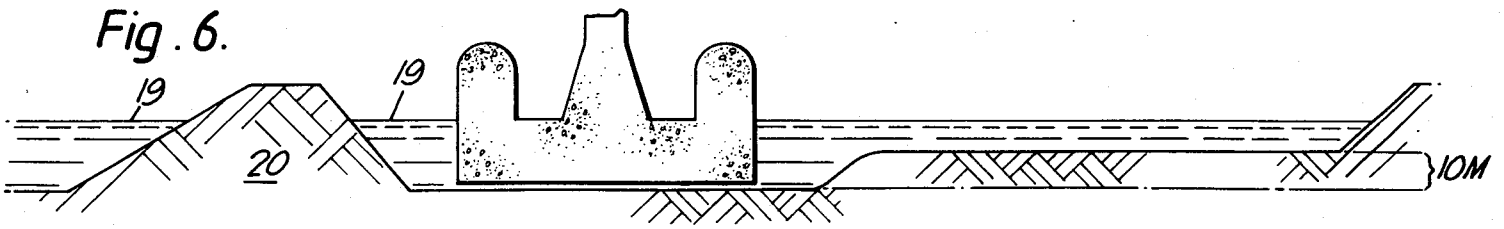

FIGS. 4–6 show an alternative embodiment according to the invention, where the floating structure is built at a greater distance from the sea than in the embodiment according to FIGS. 1–3. As in the embodiment in FIGS. 1–3, a pit 3 is first excavated from a first level 5 down to a second level 6, whereupon the structure 7 is erected completely or partly in the pit 3. In this embodiment the level 6 may for example be 7 meters below the level of the sea 2. Before or concurrently with the erection of the structure 7, a second pit 15 is excavated, this pit being deeper than the pit 3 and being open towards the pit 3, as indicated in FIGS. 5 and 6. The bottom of the pit 15 will be at a third level 16 which is lower than the level 6, for example 10 meters lower. Next, the depth of both pits 3 and 15 is increased by building the continuous upper edge of the pits up to a fourth level 17. The level 17 may lie somewhat above the surface of the sea 2, for example about 10 meters. Afterwards, both pits 3 and 15 are filled with water 23 up to a level 18, which is sufficient for the floating structure 7 to clear the bottom 6 of the pit 3. The level 18 may be approximately the same as the level 17. Next, as shown in FIG. 6, the structure is floated over to the pit 15, whereupon the water in both pits is lowered to a fifth level 19 corresponding to the level of the sea 2 on the outside. The land masses delimiting the pit 15 are generally designated by reference numeral 20, these masses forming a dike against the sea on the outside. As indicated above, this dike 20 consists of the original dike 21 and the upper dike part 22, i.e. between the levels 5 and 17, as is apparent from FIG. 5. When the level of the water in the two pits is equal to the level of the sea, the dike 20 is removed, whereupon the structure may be floated out.

I claim:

1. A method for building a floating structure, e.g. a concrete offshore platform, where a pit, separated from the sea by means of sand or gravel deposits, is excavated from a first level down to a second level, and where the structure is erected entirely or partly in the pit, characterized by (a) increasing the depth of the pit by building the upper edge of the pit from the first level up to a third level, (b) filling the pit, which at this stage of the method has a total depth equal to the distance in height between said third level and the second level, with water so that the structure floats, (c) removing deposits from below the structure and said second level in order to lower the bottom of the pit to a fourth, lower level while maintaining the level of the water in the pit, (d) lowering the level of the water in the pit to a fifth level corresponding to the level of the sea on the outside, and (e) removing the land masses separating the pit from the sea, whereupon the structure may be floated out of the pit.

2. A method according to claim 1, characterized in that the deposits situated under the structure and said second level are removed by pumping.

* * * * *